US007748391B2

(12) United States Patent
Vance

(10) Patent No.: US 7,748,391 B2
(45) Date of Patent: Jul. 6, 2010

(54) COMB FOR LIFTING HAIR UPWARDLY

(76) Inventor: Greg Vance, 10175 Park Meadows Dr., Unit #205, Lone Tree, CO (US) 80124

( * ) Notice: Subject to any disclaimer, the term of this patent is extended or adjusted under 35 U.S.C. 154(b) by 421 days.

(21) Appl. No.: 11/749,009

(22) Filed: May 15, 2007

(65) Prior Publication Data

US 2008/0283075 A1 Nov. 20, 2008

(51) Int. Cl.
*A45D 24/06* (2006.01)

(52) U.S. Cl. ..... 132/132; 132/126

(58) Field of Classification Search ..... 132/120, 132/126, 128, 129, 131, 132, 138, 141, 142, 132/145, 152, 151, 156, 159, 160
See application file for complete search history.

(56) References Cited

U.S. PATENT DOCUMENTS

| | | | | |
|---|---|---|---|---|
| 181,904 | A * | 9/1876 | Williams | 132/141 |
| 258,294 | A * | 5/1882 | Hall | 132/215 |
| 1,663,078 | A * | 3/1928 | Harper | 132/118 |
| 3,603,323 | A | 9/1971 | Avella | |
| 3,608,565 | A | 9/1971 | Ensign | |
| 3,628,545 | A | 12/1971 | Moody | |
| 3,894,548 | A | 7/1975 | Suvino | |
| D269,820 | S | 7/1983 | Bisson | |
| 5,007,442 | A * | 4/1991 | Hirzel | 132/218 |
| 5,012,830 | A * | 5/1991 | Vaccaro et al. | 132/213.1 |
| D389,271 | S | 1/1998 | Celik | |
| 5,865,188 | A | 2/1999 | Marquez | |
| 5,865,191 | A * | 2/1999 | Kimeta | 132/210 |
| 6,062,231 | A | 5/2000 | De Laforcade | |
| 6,250,312 | B1 | 6/2001 | Dasilva | |
| D456,611 | S | 5/2002 | Kwong | |
| D468,863 | S | 1/2003 | Irving | |
| 6,877,230 | B2 | 4/2005 | Tapia | |
| 2005/0076930 | A1 | 4/2005 | Yuen | |
| 2005/0166939 | A1 | 8/2005 | Stroud | |
| 2008/0006287 | A1 * | 1/2008 | Gueret | 132/218 |

* cited by examiner

*Primary Examiner*—Cris L Rodriguez
*Assistant Examiner*—Rachel R Steitz
(74) *Attorney, Agent, or Firm*—Leyendecker & Lemire, LLC; Kurt P. Leyendecker

(57) ABSTRACT

A comb is described having two sets of opposing tines that are connected together by way a biasing hinge. The comb is utilized in styling hair and, in particular, to lift short hair vertically upwardly.

16 Claims, 3 Drawing Sheets

COMB FOR LIFTING HAIR UPWARDLY

FIELD OF THE INVENTION

This invention relates to devices for styling hair on a person.

BACKGROUND

Numerous popular hairstyles among men and women require their hair be lifted generally vertically during the styling process. For instance, the instructions on many hair spray containers direct a user to spray the hair spray at the base and roots of his/her hair to help maximize the body imparted to the head of hair. Accordingly, a user, especially one with longer hair, needs to lift his/her hair upwardly to expose the roots and base to the stream of hair spray. Also, one common technique of drying hair, especially longer hair with a blow dryer is to dry from the scalp or base of the hair to help create volume. This technique, accordingly, requires the hair to be lifted upwardly to expose the scalp.

One style popular among some men and even women comprises applying a styling gel a relatively short hair (about 1-2.5 inches in length) and vertically and/or upwardly lifting the hair such that the hair maintains its vertical orientation once the gel dries. Typically, a person first applies a copious amount of styling gel to the hair using his hands and then immediately begins to run his fingers through the wet hair while gently pulling the hair upwardly. As can be appreciated, fingers do very little to separate groupings of hair and as a result the hair can appear as a relatively small number of vertically-orientated groupings.

To achieve the lifting of hair as necessary for various styling regimens men and women typically use a standard comb held in a generally horizontal orientation to lift their hair upwardly. First, a person inserts the combing to the hair and then moves the horizontally-oriented comb upwardly thereby pulling strands of hair upwardly as well. Unfortunately, the ability to effectively lift hair using this method can depend of where on a person's scalp the method is being used. For instance, this method works typically well around the periphery of a person's scalp, but it is much more difficult to lower a horizontally oriented comb to a person's scalp proximate the middle and top of the head without disturbing the hair around the periphery. Accordingly, lifting the hair upwardly using a horizontally oriented comb can be frustrating.

Brushes (such as round brushed having a set of bristles that circumscribe handle on one end) are also used to help lift hair upwardly during drying and styling. While these can be very effective, they can be somewhat time consuming to use especially when strands of hair that have become partially wedged between and intertwined with the packed and dense bristles of the brush and therefore require effort and additional time to separate the brush head from the hair.

DETAILED DESCRIPTION

Figure 1:
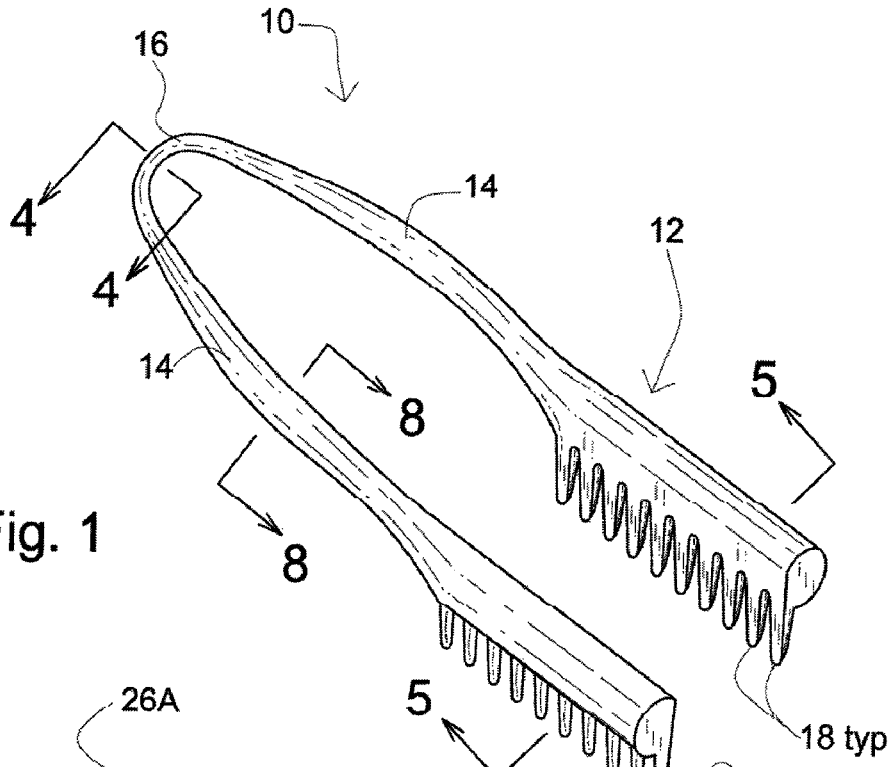
FIG. 1 is an isometric view of a tong comb according to one embodiment of the present invention.

Embodiments of the present invention comprise a comb having two planar sets of spaced and opposing tines that are coupled by way of a biasing hinge. In one variation, the longitudinal axes of the tines from each set are generally parallel with the axes of the tines of the opposing set. In another variation, the tines from each set are canted towards the tines of the other set, such that the distal ends of the tines from each set are closer to each other than the proximal ends. In yet another variation, the tines of each set curve towards the tines of the other set.

In certain embodiments, a handle portion extends rearwardly, typically but not necessarily 2.5-6 inches, from a backside of each set a tines. The respective handles are joined together at their proximal ends by way of a hinge that biases the handles and their respective sets of tines away from each other. In some variations, a hinge can be a living hinge wherein the entirety of the comb is integrally molded as a single unitary piece. In other variations, a spring that is coupled to the proximal ends of both handle portions may be provided as a hinge. In yet other variations, the proximal ends of the handle portions may be pivotally connected and a separate spring may be provided to bias the handles and the associated sets of tines away from each other.

Regardless of the embodiment or variation of the present invention utilized, the opposing planar sets of tines are brought together in use by compressing the handles. In some variations, the tines of the opposing sets interleave with each other when compressed, or in other variations, they may merely abut each other along each set's inside surface.

Operationally, the user brings the distal end of the spaced apart sets of tines into contact with the surface of his/her scalp. Next, he/she compresses the biasing hinge by way of the handles thereby bringing the sets of tines in contact with each other with hair contained therebetween. The user then pulls the comb upwardly to lift the associated hair into a generally vertical disposition. As necessary, the user performs whatever operation he/she desires on the lifted hair portion, such as applying hair spray or is blow drying hair to add volume thereto. This process is repeated on other portions of the user's scalp and hair until the user is satisfied.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment", "one variation", "a variations" and similar phrases mean that a particular feature, structure, or characteristic described in connection with the embodiment is included in at least an embodiment of the invention. The appearance of the phrase "in one embodiment" in various places in the specification are all not necessarily meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

As used herein, the term "tine" or "tines" are used in reference to the prongs on combs that are primarily used on hair. Tines are differentiated from bristles as our found in hair brushes primarily in relation to their relative stiffness. Compared to tines, bristles are relatively flexible and have relatively small cross sectional areas. In other words they are designed to give and bend when placed in contact with a scalp and moderate pressure is applied. Tines on the other hand have larger cross sectional areas and will give slightly when pressure is applied but will not give significantly. Tines are typically, but not necessarily, integrally fabricated and/or molded with an associated handle; whereas, bristles are attached to handles and handle assemblies in one or more operations subsequent to the fabrication of the handle and the plurality of bristles. The term "set of tines" as used herein refers to a plurality of tines that are all aligned in a single row.

A First Embodiment Tong Comb

Figure 5A:
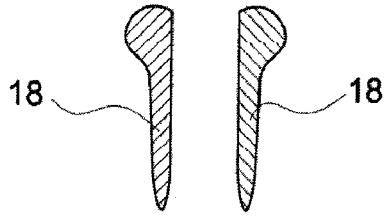
FIGS. 5A & 5B are cross-sectional views of the tong comb of FIG. 1 taken generally along line 5-5 illustrating the orientation of the comb's tines in both open and closed configurations according to an in embodiment of the present invention.
Figure 5B:
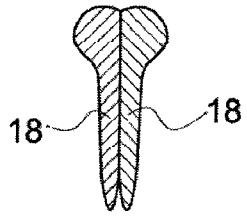

A first embodiment tong comb is illustrated primarily in FIGS. 1, 5A & 5B. It comprises two sets of planar tines 12 wherein the longitudinal axes of the tines 18 of each set are generally parallel to the longitudinal axes of the other set. Furthermore, a plane formed by the inside surface of one set of tines is generally parallel to a plane formed by the inside surface of the other set of tines. As illustrated, the tines of each set extend downwardly from the distal portion of a handle rail 14. The handle rail associated with each set of tines further extends to a proximal end comprising a living hinge 16. The living hinge biases the two sets of tines apart from each other. A typical distance between the inside surfaces of each set is about ½" to 3.5"; however, this spacing may vary in certain variations.

The first embodiment comb 10 is typically molded as a single unitary piece. The comb typically comprises a polymeric material, such as but not limited to polyethylene, polypropylene, polycarbonate or nylon. Thermoset or thermoplastic polymers may be utilized. One manufacturing processes used to manufacture the comb includes injection molding. Furthermore, the comb may be alternatively comprised of other materials including metal, bone or wood.

The length and number of tines 18 provided in each set can vary significantly from embodiment to embodiment and variation to variation. A small number of tines are illustrated in the figures for purposes of clarity but it is understood that in most embodiments the number of tines will often be more numerous than is shown. Furthermore, the spacing of the tines can vary.

In some embodiments, such as those illustrated, the lengths and spacing of the tines in a particular set are all similar to each other and the lengths and spacing of the tines in each set of the two of a tong comb embodiment are usually similar. Other embodiments are contemplated wherein the lengths of the tines in a set may vary relative to other tines in the set. For instance, the bottom ends of the tines in a set may form an arc such that the lengths of the tines gradually decrease from the ends of the set towards the middle of the set. Other variations concerning tine length are also contemplated as would be obvious to one of ordinary skill in the art given the benefit of this disclosure.

The dimensions of the tines 18 are generally similar to combs currently on the market. For instance in some, but not all variations of the described embodiments, each set of tines comprises: preferably about 3.5 to 20 tines an inch; more preferably about 5.5 to 18 tines per inch and most preferably about 7.5-16 tines per inch. Variations with high tine densities facilitate lifting finer upright hair groupings; whereas, the lower densities facilitate lifting grosser upright hair groupings. The length of the tines measured from the bottom of the handle rail typically vary from about 0.5-3.0 inches in length. The width or thickness of the tines (generally perpendicular to an longitudinal axis of the associated handle rail 14) from variation to variation can vary as well from about 0.10" to 0.250" and the spacing between the tines for a particular set are generally, but not necessarily, similar to the widths of respective tines.

The tines 18 generally have a rectangular or oval cross section and taper a bit proximate their distal ends, although this is not necessarily always the case. The depth of the tines (typically, the measurement perpendicular to the plane formed by a set of aligned tines) is typically, but not necessarily, about 0.10" to 0.375". The depths of the tines, which are sometimes greater than the widths of the tines, act to stiffen the tines especially to lateral loading as typically occur when the tines of one set our compressed against the tines of the other set in use. It is to be appreciated; however, that embodiments having square or circular cross sections, especially in relation to the wider tines, are contemplated.

As shown, each set of tines extends downwardly from a distal portion of its respective handle rail; however, variations are contemplated where each set of tines extends substantially the length of its respective handle rail. Typical handle rails extend about 8-10 inches in length with the length of the distal portion including a set of tines being about 1.5-6.0 inches in length, but more typically 2.0-4.0 inches in length.

FIGS. 5A and 5B provide a cross-sectional view of a pair of tines, one from each set. Normally, the tines from each set our spaced apart as illustrated in FIG. 5A. When a user compresses the handle rails towards each other to capture hair therebetween, the inside surfaces of the tines from each set are brought into contact with each other as is best illustrated in FIG. 5B, thereby permitting the user to lift or pull the hair upwardly. In some variations, such as the one illustrated, the inside surface of each tine from one set is aligned with and contacts the inside surface of a tine of the opposing set. In yet other variations, the corresponding tines of each set are offset relative to each other such that a tine from one set is typically received into a space between two tines of the opposing set. In other words, the tines from one set interleave with the tines of the opposing set when the comb is compressed.

Figure 8A:
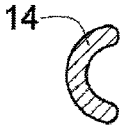
FIGS. 8A-8E are cross-sectional views of the tong comb of FIG. 3 taken along the line 8-8 illustrating various cross-sections of the handle portion according to embodiments of the present invention
Figure 8B:
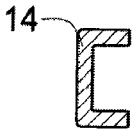
Figure 8C:
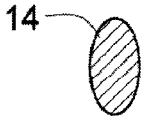
Figure 8D:
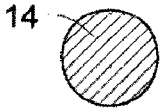
Figure 8E:
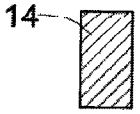

As can be appreciated, the handle rails 14 must be sufficiently stiff, or rigid, so that the rails do not bend significantly under normal forces utilized to compress the sets of tines 12 against each other and hold hair therebetween as the hair is lifted upwardly. The relative stiffness of the rail depends both on its geometric configuration as well as the stiffness, or modulus, of the material from which the comb 10 is fabricated. FIGS. 8A-E illustrate possible cross-sections of the handle rails that could be utilized to provide sufficient stiffness thereto while permitting the tong comb to be fabricated from an inexpensive polymeric material. It is noted, however, that various other cross-sections may be utilized as well. FIG. 8A illustrates a cross-section having a convex outer surface and a concave inner surface. FIG. 8B illustrates a C-section with an open inside portion and a flat outside portion. FIG. 8C illustrates an ovalized cross-section. FIG. 8D illustrates a circular cross-section, and FIG. 8E illustrates a rectangular cross-section.

Figure 4:
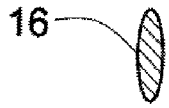
FIG. 4 is a cross-sectional view of the tong comb of FIG. 1 taken a long line 4-4 illustrating a living huge portion thereof according to one embodiment of the present invention.

Unlike the handle rails 14, the living hinge 16 must be sufficiently flexible to permit a user to compress it with minimal effort while being sufficiently resilient to spring back to its normal shape once the user relaxes his grip. Furthermore, the hinge should be resistant to torsional bending since that the sets of tines 12 should remain aligned with each other when the user compresses the handles 14. FIG. 4 illustrates a cross-sectional view of an ovalized living hinge. Of particular note, the major axis of the oval is substantially longer than the minor axis making the hinge fairly flexible relative to bending in the direction of the minor axis while making the hinge fairly stiff and resistant to bending in the direction of the major axis. The resistance to bending along the major axis also minimizes the torsional bending at the hinge. Generally speaking, the ratio of the major to minor axes of the hinge cross-section compared to a similar ratio of an ovalized handle rail cross-section (see FIG. 8C) is substantially larger. It is appreciated that the cross-section of living hinge portion of the comb will typically gradually transition to the cross-section of the respective handle rails.

A Second Embodiment Tong Comb

Figure 2:
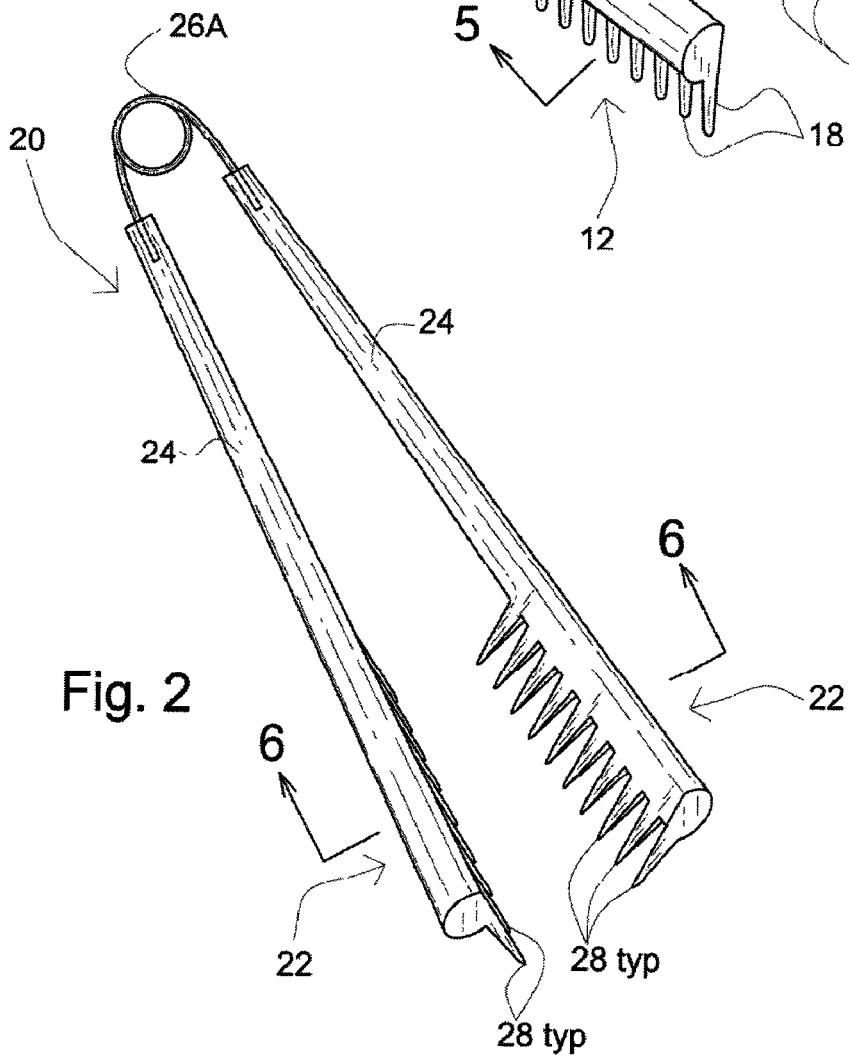
FIG. 2 is an isometric view of a tong comb according to another embodiment of the present invention.
Figure 2A:
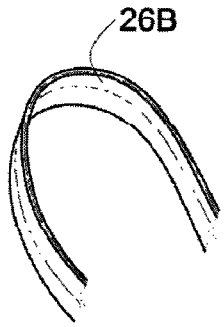
FIG. 2A is an isometric view of a leaf spring as can be used in embodiments of the present invention.
Figure 6A:
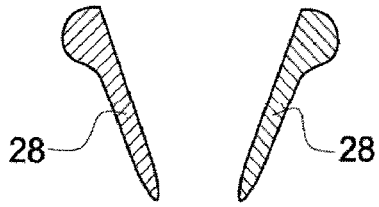
FIGS. 6A & 6B are cross-sectional views of the tong comb of FIG. 2 taken generally along line 6-6 illustrating the orientation of the comb's tines in both open and closed configurations according to an embodiment of the present invention.
Figure 6B:
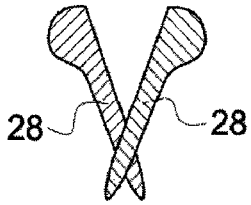

A second embodiment tong comb 20 is illustrated in FIGS. 2, 6A & 6B. this embodiment is generally similar to the first embodiment 10 excepting the inwardly canted orientations of the sets of tines 22 and the replacement of the living hinge 16 with a metallic spring 26A or 26B (typically, although not necessarily, fabricated from stainless steel). It is to be appreciated that the cross-section of the handle rails 24 can vary in much the same way as discussed above for the first embodiment. Furthermore, the number, length and spacing of the tines can be substantially similar to those of the first embodiment.

The living hinge of the first embodiment is replaced in the second embodiment with a coiled metallic spring 26A or a U-shaped leaf spring 26B of which it ends are inserted and secured to the proximal ends of the respective handle rails 24. Functionally, the springs serve the same purpose as the living hinge in the first embodiment. The design of the spring can vary substantially from the illustrated versions.

As can be appreciated, the second embodiment is typically fabricated in three distinct and separate pieces: a left handle rail 24 and its associated set of tines 22; the right handle 24 and its associated set of tines 22; and the aforementioned metallic spring 26A. The left and right handles are typically fabricated from a polymeric material including but not limited to polyethylene, polypropylene, nylon and hard rubber. The respective handles can be injection molded with the spring being inserted into the proximal ends in later operation. In yet another variation, the spring can be placed in a mold with the handles being injection molded onto and, as applicable, around the spring. For instance, variations are contemplated that have the general appearance of the first embodiment but include a metallic spring underneath the polymeric material at the proximal end of the comb.

Referring to FIGS. 6A & 6B, the sets of planar tines 28 are canted inwardly towards each other such that the distal ends of the tines from each set are closer to the distal ends from the opposing set than are the corresponding proximal ends. The angle of the cant can vary depending on the particular variation but is preferably between 5° to 45°; more preferably between 10° to 30°; and most preferably between 15° to 25°. Further as illustrated, the tines from one set are offset relative to the tines of the other set such that the tines interleave when the handle rails are compressed during use. It is appreciated, however, that the tines can be oriented to abut each other and their distal ends.

A Third Embodiment Tong Comb

Figure 3:
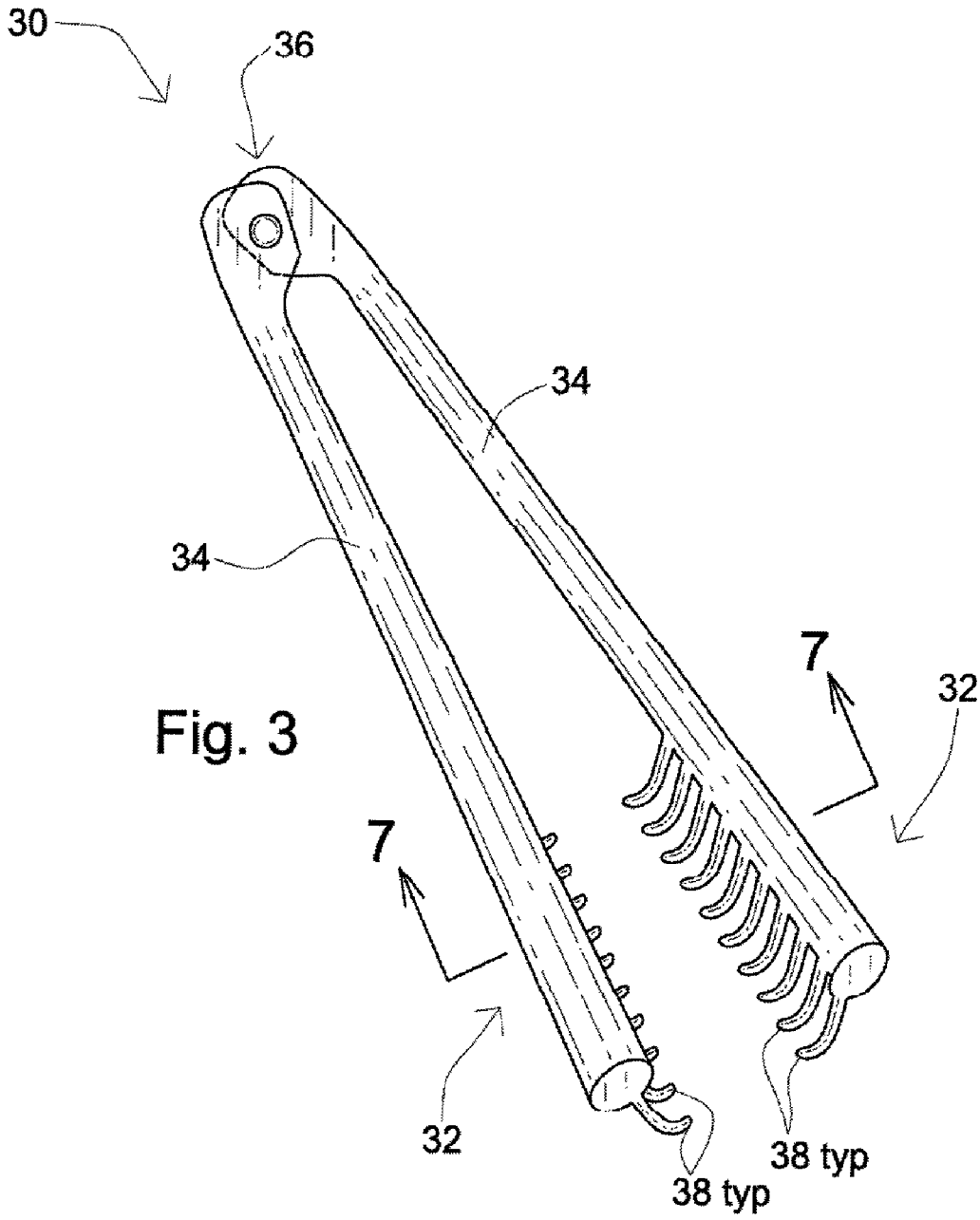
FIG. 3 is an isometric view of the tong comb according to yet another embodiment of the present invention.
Figure 7A:
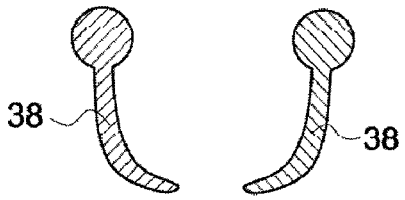
FIGS. 7A & 7B are cross-sectional views of the tong comb of FIG. 3 taken generally along line 7-7 illustrating the orientation of the comb's tines in both open and closed configurations according to an embodiment of the present invention.
Figure 7B:
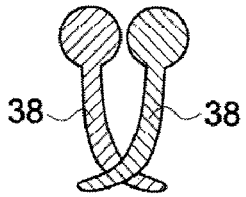

A third embodiment tong comb 30 is illustrated in FIGS. 3, 7A & 7B. this embodiment is generally similar to the second embodiment 20 excepting the inwardly curved orientations of the sets of tines 32 and the replacement of the metallic spring hinge with pivotally interconnecting handle rail proximal ends 36 and a biasing spring (not illustrated) to urge the handles and sets of tines apart from each other. It is to be appreciated that the cross-section of the handle rails 34 can vary in much the same way as discussed above for the first embodiment. Furthermore, the number, length and spacing of the tines 28 can be substantially similar to those of the first and second embodiments.

The pivotal hinge 36 is substantially similar in construction to commonly known molded hinge assemblies, such as those found in kitchen tongs. Typically, one or more protrusions are molded into the proximal end of one handle rail and corresponding openings are provided in the opposing handle rail's proximal end. The protrusions are received in the openings permitting the handles 34 to pivot accordingly. Stops are molded into the ends as well to limit the range of motion of the handle rails so that they cannot open greater than a desired separating distance. A coil, leaf or ribbon spring is placed within the molded ends to bias the handles and the sets of tines 32 into their normally separated position.

Referring to FIGS. 7A & 7B, the tines of each set of tines curve inwardly towards the tines 38 of the other set such that the distal ends of the tines from each set are closer to the distal ends of the opposing set than are the corresponding proximal ends. Typically, the tines extend in a generally linear fashion downwardly from the handle rail 34 a distance before curving and thereafter they curve along an arc anywhere from about 30° to 90° wherein the final distal portion of each tine also extends generally linearly for a short distance. In other variations, the radius of curvature may be greater and the tines may curve over substantially their entire lengths. Further as illustrated, the tines from one set are offset relative to the tines of the other set such that the tines interleave when the handle rails are compressed during use. The interleaving of the tines coupled with the canted or curved tines as shown in the second and third embodiments act to help separate but hold strands of hair as the strands are lifted upwardly.

A Method of Using a Tong Comb to Lift Hair Vertically

To vertically or upwardly lift a grouping of hair, a user first lowers the comb on to the scalp with the sets of tines separated and generally vertically orientated. If the user desires to lift a smaller grouping of hair, he/she may partially compress the handles to partially bring the sets of tines closer to each other prior to lowering them to the scalp. As can be appreciated, by lifting smaller groupings of hair the resulting tufts of vertical or upright hair will be finer than is larger groupings are lifted. Once the distal ends of the comb are brought into contact with the scalp or close thereto, the user fully compresses the handle rails and the associated sets of tines to grab the grouping of hair therebetween. Finally, with the comb in the closed or compressed position the user pulls the comb generally vertically upwardly in a swift motion. The grip on the handle rails is relaxed and the process is repeated on substantially the same grouping of hair, a new grouping of hair or new grouping that overlaps a bit with the previous grouping. Hair spray may sometimes be applied to the base of the lifted hair proximate the user's scalp to add body to the hair. In other variations, the user may apply hair gel to the hair before or during the lifting process. In other methodologies, the user may blow dry his/her scalp and the base of the lifted hair with a hair dryer.

Other Embodiments and Variations

The various preferred embodiments and variations thereof illustrated in the accompanying figures and/or described above are merely exemplary and are not intended to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the three embodiments illustrated herein each include sets of tines and hinge mechanisms that differ from each other. The sets of tines from any one of the illustrated embodiments can be combined with any hinge mechanism from any one of the illustrated embodiments to create another embodiment. For example, a tong comb having the living hinge mechanism of the FIG. 1 embodiment 10 can be combined with the inwardly curved sets of tines 32 of the FIG. 4 embodiment 30 to create another distinct embodiment.

I claim:

1. A comb for styling human hair, the comb comprising:

a first set of tines;

a second set of tines;

a first handle rail extending at least along a proximal end of each tine of the first set of tines, the first set of tines being integral with the first handle rail, the first handle rail forming a first handle rail longitudinal axis;

a second handle rail extending at least along a proximal end of each tine of the second set of tines, the second set of tines being integral with the second handle rail, the second handle rail forming a second handle rail longitudinal axis; and a biasing hinge, the biasing hinge coupled to proximal ends of both the first and second handle rails and adapted to hold each handle rail and each respective set of tines in a spaced apart relationship from the other handle rail and other set of tines;

wherein (i) the tines of the first set of tines are coincident with each other relative to the first handle rail longitudinal axis, (ii) the tines of the second set of tines are aligned with each other relative to the second handle rail longitudinal axis, (iii) the first and second set of tines have a similar tine density along their respective handle rail longitudinal axis of 3.5-20 tines per inch, (iv) each tine of the first set of tines is substantially coplanar with each other tine in the first set forming a first plane, (v) each tine of the second set of tines is substantially coplanar with each other tine in the second set forming a second plane, and (vi) the tines of the first set are canted inwardly towards the tines of the second set and the tines of the second set are canted inwardly towards the first set, an angle formed between an intersection of the first and second planes being between 5-45 degrees, and (vii) the tines from the first set are adapted to interleave with the tines of the second set when the handle rails are compressed towards one another.

2. The comb of claim 1, wherein the tines of the first set are curved inwardly towards the tines of the second set and the tines of the second set are curved inwardly towards the first set.

3. The comb of claim 1 wherein a substantial majority of the tines of the respective first and second sets having similar widthwise dimensions and are each spaced apart from neighboring tines in its respective set a distance equal to or greater than the tines widthwise dimension.

4. The comb of claim 1, wherein the tines of the respective first and second sets have widthwise dimensions of about 0.10" to 0.25".

5. The comb of claim 1 wherein the respective sets of tines, the respective handle rails, and the biasing hinge are comprised of a single unitary piece of material.

6. The comb of claim 5, wherein the single unitary piece of material comprises a polymeric material.

7. The comb of claim 1 wherein the biasing hinge comprises an integrally molded living hinge.

8. The comb of claim 1 wherein the biasing hinge comprises a metallic spring.

9. The comb of claim 1 wherein the tine density is about 8-16 tines per inch.

10. The comb of claim 1 wherein the spacing between the first set of tines and the second set of tines with the biasing hinge in a normal resting position is about 0.50" to 1.5".

11. A method of styling hair using the comb of claim 1, the method comprising:

holding the comb in a hand by the handle rails;

lowering the sets of tines towards a scalp of a user beneath a top of the hair with the sets of tines spaced apart from one another;

compressing the handle rails bringing the opposing sets of tines into contact with each other with a section of the hair caught therebetween; and raising the comb with the sets of tines compressed against each other thereby lifting the section of hair upwardly.

12. The method of claim 11, further comprising applying one of a styling gel and hair spray to the hair.

13. The method of claim 11, further comprising repeating said lowering, compressing and raising on a plurality of sections of hair.

14. The method of claim 11 wherein the sets of tines are spaced apart from each other 0.5-1.5" during said lowering.

15. A comb for styling human hair, a unitary one piece comb comprising:

a first portion comprising a first set of tines;

a second portion comprising a second set of tines, the second set of tines opposing and being spaced apart from the first set of tines;

a third portion comprising a first handle rail extending at least along a proximal end of each tine of the first set of tines, the first handle rail forming a first handle rail longitudinal axis;

a fourth portion comprising a second handle rail extending at least along a proximal end of each tine of the second set of tines, the second handle rail forming a second handle rail longitudinal axis; and a fifth portion comprising a biasing living hinge, the biasing living hinge integrated with proximal ends of both the first and second handle rails and adapted to hold each handle rail and each respective set of tines in a spaced apart relationship from the other handle rail and other set of tines;

wherein (i) the tines of the first set of tines are coincident with each other relative to the first handle rail longitudinal axis, (ii) the tines of the second set of tines are coincident with each other relative to the second handle rail longitudinal axis, (iii) the first and second set of tines have a similar tine density along their respective handle rail longitudinal axis of 8-16 tines per inch, (iv) the comb comprises a plastic material; (v) each tine of the first set of tines is substantially coplanar with each other tine in the first set forming a first plane, (vi) each tine of the second set of tines is substantially coplanar with each other tine in the second set forming a second plane, and (vii) the tines of the first set are canted inwardly towards the tines of the second set and the tines of the second set are canted inwardly towards the first set, an angle formed between an intersection of the first and second planes being between 5-45 degrees, and (viii) the tines from the first set are adapted to interleave with the tines of the second set when the handle rails are compressed towards one another.

16. A comb for styling human hair, the comb comprising:

a first set of tines, the tines of the first set being substantially coplanar with each other on a first plane;

a second set of tines the tines of the second set being substantially coplanar with each other on a second plane;

a first handle rail including (i) a first tine section extending at least along a proximal end of each tine of the first set of tines and (ii) a first handle section, the first set of tines and the first handle rail being unitarily fabricated;

a second handle rail including (i) a second tine section extending at least along a proximal end of each tine of the second set of tines and (ii) a second handle section, the second set of tines and the second handle rail being unitarily fabricated;

a biasing hinge, the biasing hinge coupled to proximal ends of both the first and second handle rails and adapted to hold each handle rail and each respective set of tines in a generally parallel spaced apart relationship from the other handle rail and other set of tines, a distance between the first and second set of tines being between about 0.5-1.5";

wherein (i) the first plane and the second plane are substantially parallel to each other and (ii) each tine of the first set of tines extend in a generally linear fashion downwardly from the first tine section then curve at a distal end and each tine of the second set of tines extend in a generally linear fashion downwardly from the second tine section then curve at a distal end, and (iii) the tines from the first set are adapted to interleave with the tines of the second set when the handle rails are compressed towards one another.

* * * * *